US009207029B2

(12) United States Patent
Klarborg

(10) Patent No.: US 9,207,029 B2
(45) Date of Patent: Dec. 8, 2015

(54) AMMUNITION MAGAZINE FOLLOWER

(71) Applicant: Martin Klarborg, Brovst (DK)

(72) Inventor: Martin Klarborg, Brovst (DK)

( * ) Notice: Subject to any disclaimer, the term of this patent is extended or adjusted under 35 U.S.C. 154(b) by 0 days.

(21) Appl. No.: 14/349,461

(22) PCT Filed: Oct. 4, 2012

(86) PCT No.: PCT/DK2012/050370

§ 371 (c)(1),
(2) Date: Apr. 3, 2014

(87) PCT Pub. No.: WO2013/050038

PCT Pub. Date: Apr. 11, 2013

(65) Prior Publication Data

US 2015/0075049 A1 Mar. 19, 2015

Related U.S. Application Data

(60) Provisional application No. 61/543,197, filed on Oct. 4, 2011.

(51) Int. Cl.
*F41A 9/65* (2006.01)
*F41A 9/70* (2006.01)

(52) U.S. Cl.
CPC ..... *F41A 9/70* (2013.01)

(58) Field of Classification Search
CPC ..... F41A 9/65; F41A 9/70; F41A 9/71
USPC ..... 42/50, 49.02, 49.01, 22, 18
See application file for complete search history.

(56) References Cited

U.S. PATENT DOCUMENTS

| | | | | | |
|---|---|---|---|---|---|
| 2,951,424 | A | * | 9/1960 | Stoner | 89/179 |
| 3,345,770 | A | * | 10/1967 | Scanlon, Jr. | 42/18 |
| 3,465,463 | A | | 9/1969 | Grandy et al. | |
| 3,776,095 | A | * | 12/1973 | Atchisson | 89/128 |
| 4,058,922 | A | * | 11/1977 | Elbe et al. | 42/16 |
| 4,069,608 | A | * | 1/1978 | Jurek | 42/49.02 |
| 4,098,016 | A | * | 7/1978 | Foote | 42/16 |
| 4,169,329 | A | * | 10/1979 | Atchisson | 42/16 |
| 4,502,237 | A | * | 3/1985 | Krogh | 42/50 |
| 4,514,922 | A | * | 5/1985 | Farrar et al. | 42/50 |
| 4,617,749 | A | * | 10/1986 | Jurek | 42/16 |

(Continued)

OTHER PUBLICATIONS

International Preliminary Report on Patentability for International (PCT) Patent Application No. PCT/DK2012/050370 dated Apr. 8, 2014, 6 pages.

(Continued)

*Primary Examiner* — Michael David
(74) *Attorney, Agent, or Firm* — Sheridan Ross, P.C.

(57) ABSTRACT

An ammunition magazine follower comprises a main bottom member defining an upper and lower surface. The upper surface comprises a substantially flat portion and a parallel ridge portion, where the flat and ridge portions are arranged in the longitudinal direction of the main bottom member. One or more guides are arranged on the lower surface for guiding the follower in the magazine. An urging member such as a spring, when installed in a magazine, urges the follower away from the magazine bottom. The guide comprises at least one end wall projecting perpendicularly away from the lower surface of the main bottom member. The end wall comprises a moveable tap, where the upper part of the tap is biased and projects partly above the upper surface of the main bottom member.

6 Claims, 4 Drawing Sheets

(56) References Cited

U.S. PATENT DOCUMENTS

| | | | | |
|---|---|---|---|---|
| 4,664,015 | A * | 5/1987 | Kennedy | 89/138 |
| 4,888,900 | A * | 12/1989 | Howard | 42/50 |
| 5,357,703 | A * | 10/1994 | Chesnut et al. | 42/50 |
| 5,638,626 | A | 6/1997 | Westrom | |
| 6,470,614 | B1 * | 10/2002 | Johnson | 42/17 |
| 6,606,811 | B1 * | 8/2003 | Olson | 42/50 |
| 7,318,294 | B2 * | 1/2008 | Zimmermann | 42/7 |
| 7,533,483 | B1 * | 5/2009 | Alzamora et al. | 42/50 |
| 7,621,063 | B2 * | 11/2009 | Fitzpatrick et al. | 42/50 |
| 7,958,660 | B2 * | 6/2011 | Fitzpatrick et al. | 42/50 |
| 8,006,423 | B1 * | 8/2011 | Alzamora et al. | 42/49.01 |
| 8,028,455 | B1 * | 10/2011 | Battaglia | 42/49.02 |
| 8,225,541 | B2 * | 7/2012 | Bigley et al. | 42/49.01 |
| 8,387,296 | B2 * | 3/2013 | Overstreet et al. | 42/50 |
| 8,479,635 | B2 * | 7/2013 | Overstreet et al. | 89/181 |
| 8,677,880 | B2 * | 3/2014 | Bowles et al. | 89/34 |
| 8,689,475 | B2 * | 4/2014 | Battaglia | 42/49.02 |
| 2011/0113663 | A1 | 5/2011 | Nakayama et al. | |

OTHER PUBLICATIONS

International Search Report prepared by the European Patent Office on Dec. 20, 2012, for International Application No. PCT/DK2012/050370.

* cited by examiner

AMMUNITION MAGAZINE FOLLOWER

CROSS REFERENCE TO RELATED APPLICATIONS

This application is a national stage application under 35 U.S.C. 371 and claims the benefit of PCT Application No. PCT/DK2012/050370 having an international filing date of Oct. 4, 2012, which designated the United States, which PCT application claimed the benefit of U.S. Provisional Application No. 61/543,197 filed Oct. 4, 2011, the disclosures of which are incorporated herein by reference.

FIELD OF THE INVENTION

The present invention relates to an ammunition magazine follower which is used in the technical field of ammunition magazines used in weaponry.

BACKGROUND OF THE INVENTION

Followers are well-known in the art and are used in order to assist in dispensing uniform items such as for example ammunition cartridges.

An example is illustrated in US 20110113663, wherein a special follower is disclosed, which follower is specially designed to avoid jamming as the follower travels in the magazine.

The follower is usually placed in the bottom of the magazine such that between the follower and the real bottom of the magazine a spring is arranged. The spring urges the follower away from the bottom such that cartridges arranged in the magazine will be forced typically upwards. As the magazine is inserted in a weapon/firearm the cartridges will be dispensed from the magazine and into the chamber of a firearm.

An example of a magazine including a follower of this type is disclosed in U.S. Pat. No. 5,638,626. This magazine's follower is provided with a biased finger which in an upper position projects outside the magazine in order to arrest the bolt of the weapon. In this manner the empty magazine may be replaced. This particular follower-construction requires a special magazine and furthermore requires extra space below the follower in order to accommodate the spring biasing mechanism of the bolt catch finger. This mechanism does not allow the weapon to be fired before another magazine is correctly inserted into the weapon.

As the follower travels upwards through the magazine dispensing cartridges into the chamber the follower will, when the last cartridge is deposited in the magazine activate a bolt lock such that after the last cartridge has been fired, the bolt will be in its withdrawn position allowing the empty magazine to be replaced by a fresh magazine, i.e. a magazine loaded with cartridges.

The locked bolt or bolt catch function is used in a wide variety of weapons, collectively known as repeater type weapons.

When the first magazine has been emptied, i.e. the follower of the prior art is in its upper most position, there are no rounds to be fired from the weapon and as such during the time it takes to replace the magazine, typically 10-15 seconds, it is not possible to fire the weapon. Not until a new magazine has been correctly placed in the weapon and a cartridge introduced into the chamber, whereby the bolt catch function has been released, will it again be possible to fire the weapon.

In some instances these 10-15 seconds when replacing a magazine might be crucial. Usually, in combat other soldiers will lay down fire in order to provide cover while the magazine is replaced such that the weapon can again be active and carry out its function.

OBJECT OF THE INVENTION

In view of the time lapse and thereby lack of ability to respond to fire during the 10-15 seconds it takes to replace a magazine it is the aim of the invention to provide a new and improved magazine including a novel and improved follower which follower will ensure that there is at least one round available during the time period where the magazine is replaced.

DESCRIPTION OF THE INVENTION

The invention addresses this by providing an ammunition follower comprising

- a main bottom member defining an upper and lower surface, where said upper surface comprises a substantially flat portion and a parallel ridge portion, where said flat and ridge portions are arranged in a longitudinal direction of the main bottom member;
- guide means on the lower surface for guiding said follower in the magazine;
- means for accommodating urging means, which urging means in use when the follower is installed in a magazine urges the follower away from the magazine bottom; wherein the guide means comprises at least one end wall projecting substantially perpendicularly away from said lower surface of said main bottom member, where said end wall comprises a moveable tap, where an upper part of said tap, by biasing means in use projects at least partly above said upper surface of the main bottom member.

The provision of a movable tap where the upper part of the tap projects at least partly above the upper surface of the main bottom member provides the function that as the follower due to the influence from the urging member, typically a spring, is brought into contact with the chamber in the weapon, the tap will engage the bolt catch function. As the second last cartridge is being fired the tap engages the bolt catch function. In this position the last cartridge is still in the magazine. In order to replace the magazine the bolt catch release is activated whereby the last cartridge is loaded into the chamber, while the magazine is replaced. The weapon is now ready to fire the last cartridge, while the fresh/new magazine is inserted.

In the art, as already described above replacement of the magazine usually takes place when the follower engages the bolt catch function after having fired the last cartridge, whereas with the present invention, a live cartridge is present in the chamber of the weapon, such that during the time-span of replacing the now empty magazine, it is possible to fire the weapon.

This, of course provides the user with a great advantage in that the break in fire power is reduced to a minimum such that situations dangerous to the operator may be severely minimized. In the art there is a wide variety of weapons using the repeater principle using a bolt to fire the cartridge and the magazines are more or less alike such that it is possible to use the novel follower according to the present inventions with slight modifications without departing from the inventive principle in all types of magazines.

In a further advantageous embodiment the end-wall is provided with a cavity arranged in the end-wall's longitudinal direction, which cavity is open towards the main bottom member, where said tap is moveably arranged in said cavity, and where a cavity bottom is provided in the cavity, where a spring member is arranged between said cavity bottom and the tap, said spring urging the tap away from the cavity bottom.

By arranging the tap movably in a cavity in the follower where the tap is activated by a spring member it is ensured that the profile of the follower as such does not create any strange conditions such as jamming, blocking or otherwise in the magazine, and in this manner the follower according to the present invention will behave just like any other follower in an ammunition magazine. Only when the follower reaches the uppermost position in the magazine will the follower have a different feature, i.e. the projecting tap which will activate the bolt catch mechanism after the second to last cartridge present in the magazine.

Furthermore, by arranging the movable tab in a cavity it is possible to guide and control the movement of the tap such that it does not interfere with the operation of the magazine as such.

In a further advantageous embodiment of the invention stop means are provided in the cavity which stop means interacts with said tap, limiting the tap's travel in the cavity.

In this manner it is limited how much the tab may move in the magazine relative to the follower such that it may be very accurately determined how much the tab projects above the upper surface of the follower whereby an accurate activation of the bolt catch means and the weapon may be activated. The spring arranged in order to urge the tap away from the cavity bottom is dimensioned such that the spring force is less than the spring force urging the entire follower upwards relative to the magazine bottom such that the last cartridge by depressing the spring activating the tap may be introduced into the chamber of the weapon.

In a further advantageous embodiment of the invention the part of the tap projecting above the main bottom member projects such that the upper most part of the tap is flush with the upper most part of the ridge portion.

In this manner it is ensured that the tap does not by mistake activate the bolt catch mechanism early and at the same time that the tap does have a certain protuberance above the follower's main bottom.

In a still further advantageous embodiment of the invention the tap has a substantially rectangular or quadratic cross section defining four sides, with a hollow central part, and where wings are arranged projecting out from two opposing sides of the tap, and where a section of an, in use uppermost part of a side is lower than the other three sides.

The quadratic or rectangular shape provides for a very stiff tap structure, which is important as the tap is to engage the bolt catch mechanism in the weapon. Furthermore, some weapons can empty the magazine very quickly, and therefore the speed with which the tap engages the bolt catch mechanism may be significant, requiring a strong construction in order to assure proper functioning.

The missing part of an upper side, allows the tap to be made wider. The missing part of the side usually corresponds to the contour of a cartridge, such that the lower side of the tap can extend under the cartridge, and the "normal" height of the tap, function to engage the bolt catch mechanism.

The wings are provided in order to guide the tap in corresponding recesses provided in the main body portion.

DESCRIPTION OF THE DRAWING

The invention will now be explained with reference to the accompanying drawing wherein.

DETAILED DESCRIPTION OF THE INVENTION

Figure 1:
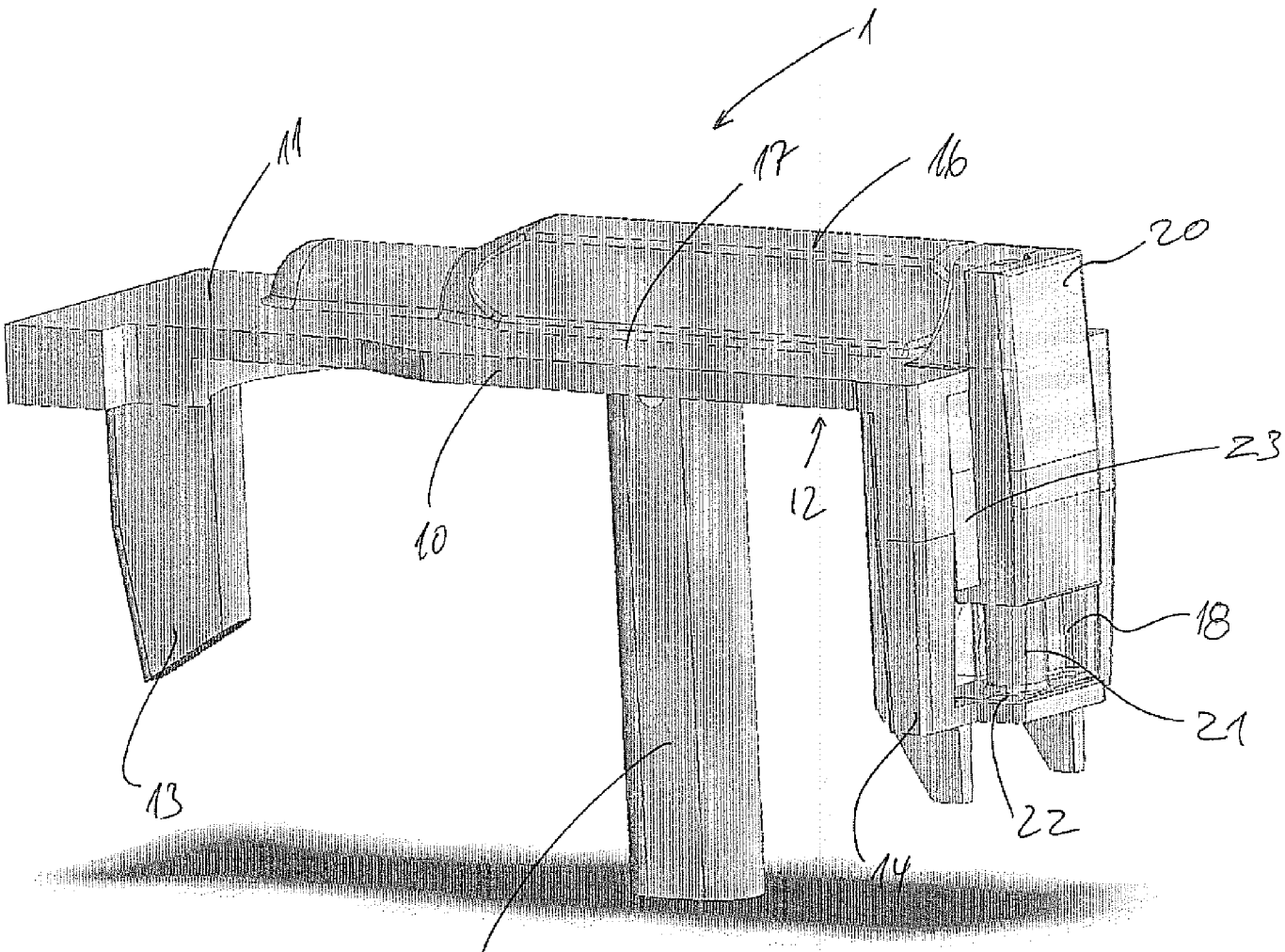
FIG. 1 illustrates a follower according to the present invention

In FIG. 1 is illustrated a follower according to the present invention.

The follower 1 comprises a main bottom member 10 having upper 11 and lower 12 surfaces. In this embodiment guide means 13, 14 extend substantially perpendicular to the upper surface 11 of the main bottom member 10. These guide means 13,14 serve to guide the follower inside the magazine (not illustrated) such that the follower 1 will follow the contour of the magazine and force cartridges (not illustrated) away from the bottom of the magazine.

Centrally a guide member 15 is provided. A spring member (not illustrated) is arranged around the guide member 15 and the bottom of the magazine (not illustrated) such that as the magazine is filled with ammunition the spring will be compressed and as cartridges are dispensed from the magazine into the chamber, the spring will expand moving the follower 1 up through the magazine.

On the upper surface 11 is provided a ridge portion 16 which has a shape substantially corresponding to a cartridge and allowing room for a flat portion 17 also provided on the upper surface 11 of the main bottom member 10. The flat portion 17 has a size such that it may accommodate a cartridge as is illustrated with reference to FIGS. 3-5.

In the end-wall 14 is provided a cavity 18. In the cavity a movable tap 20 is arranged. In this embodiment the movable tap 20 is guided by an upstanding axle 21 which axle projects from a bottom 22 in the cavity 18 and projects into a cavity (not illustrated) in the movable tap 20. In this manner the tap 20 may move up and down guided by the axle 21. In order to urge the tab 20 into the position illustrated in FIG. 1 where the tap 20 projects above the upper surface 11 of the main bottom member 10 a spring (not illustrated) is arranged between the lowermost part of the movable tap 20 and the bottom of the cavity 22. In order to further guide the tap 20 in its up and down movement the tap is provided with wings 23 of which only one is visible. The wings move in depressions 24 (see FIG. 2) such that the movement of the tap 20 is limited by the extent of the depressions 24. The magazine (not illustrated) will serve to guide the tap 20 such that the tap cannot escape the cavity 18.

As is evident from FIG. 1 the uppermost part of the tap 20 is substantially flush with the upper side of the ridge 16 such that as the follower 1 moves upwards in the magazine, the uppermost part of the tap 20 will engage the bolt's catch function in a position above the upper surface of the main body portion. Normally the upper surface 11 will engage the bolt catch function in the weapon.

Figure 2:
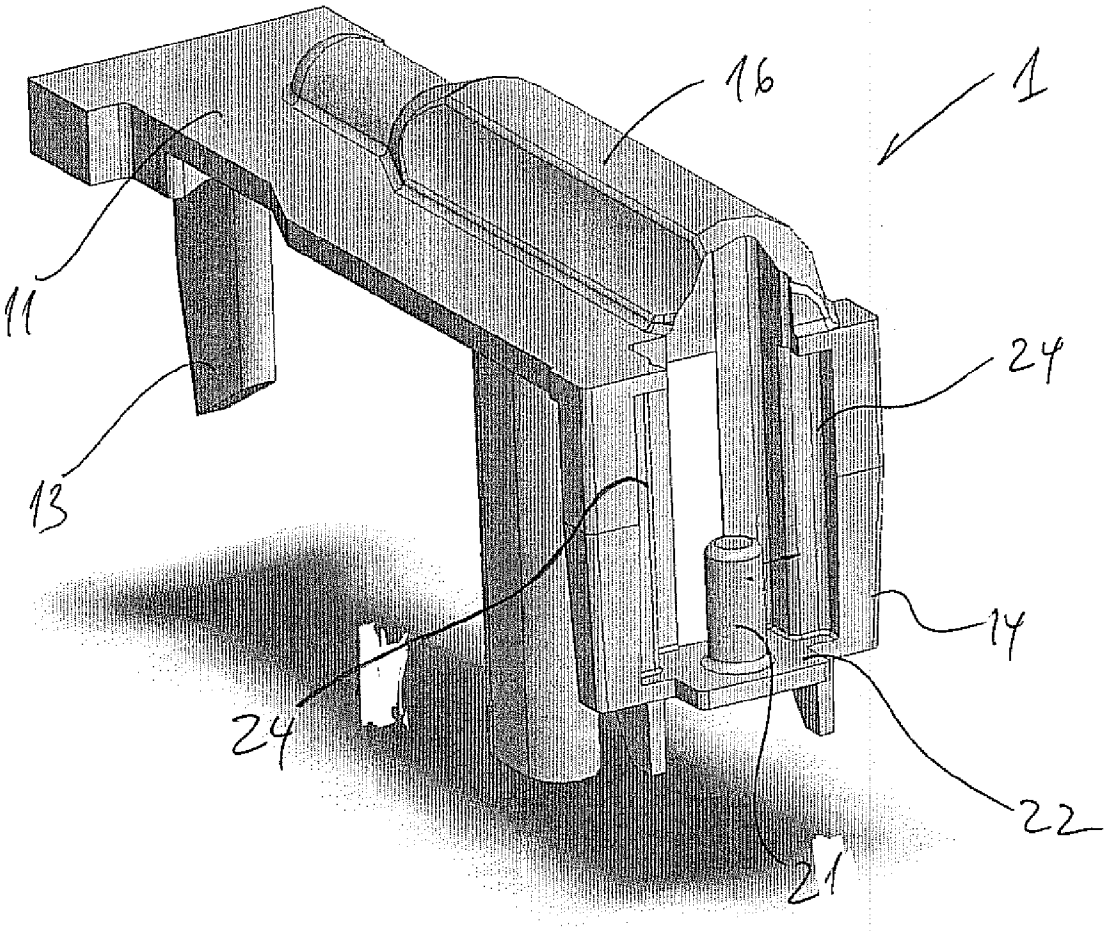
FIG. 2 illustrates the present invention where the tap has been removed in order to illustrate the guide member
Figure 3:
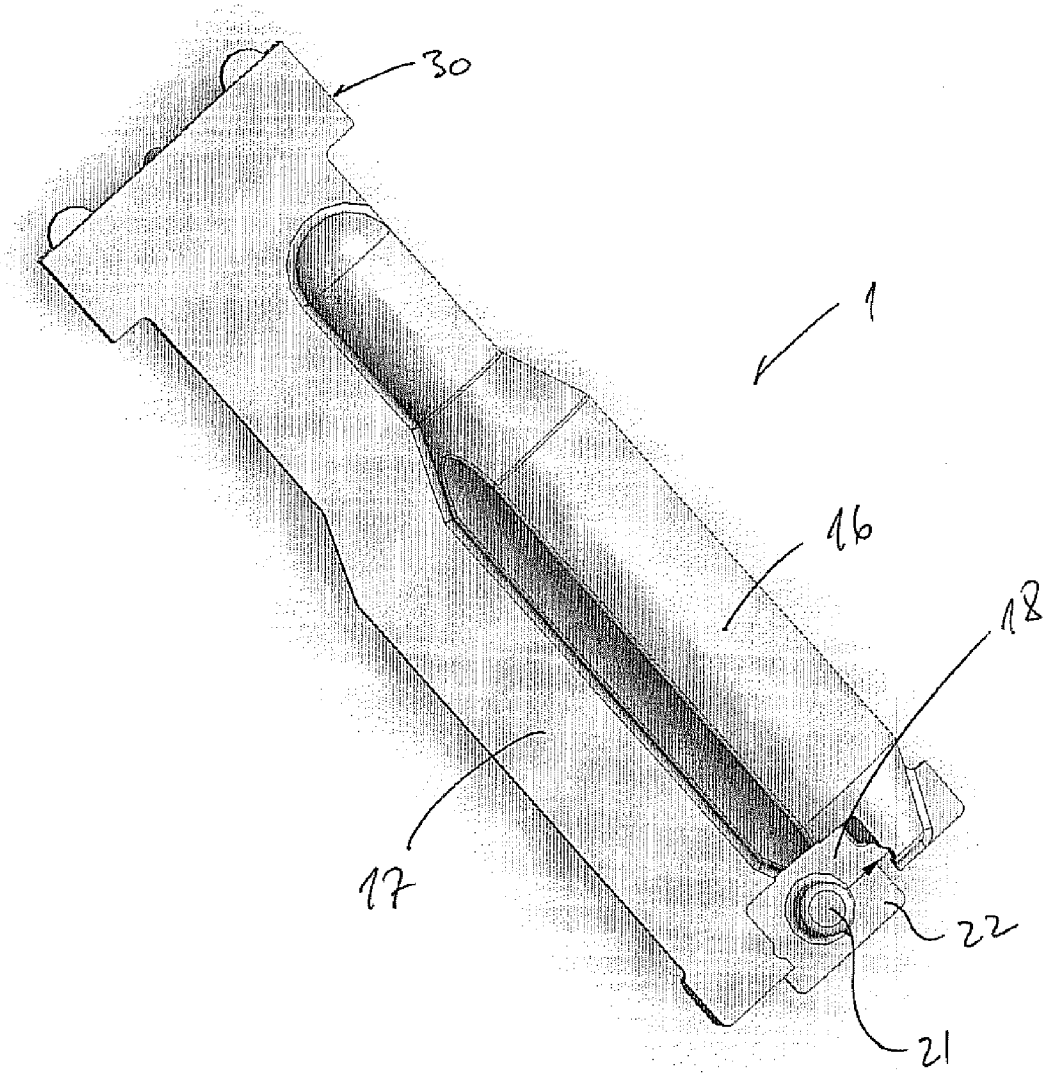
FIG. 3 illustrates a follower according to the invention seen from above

Turning to FIG. 2 the tap 20 has been removed in order to illustrate the guide member 14 of the present invention. The depressions 24 guiding the wings 23 of the tap are clearly visible as is the axle 21 which projects sufficiently upwards in order to engage an aperture provided in the movable tap 20 such that the tap cannot be removed from the follower 1 as long as the follower is arranged in the magazine. This is due to the fact that the contour of the follower as illustrated in FIG. 3 precisely corresponds to that inner contour of a magazine to which the follower is designed. It is therefore not possible for the tap to be removed from the follower 1 as long as the follower 1 is arranged in the magazine.

Turning to FIG. 3 a follower 1 according to the invention is seen from above. In this illustration the movable tap 20 has been removed in order to illustrate the axle 21 and the cavity bottom 22. Furthermore, the recess 18 into which the tap is positioned is also visible. The contour 30 of the follower is designed to fit inside a given magazine. By changing the contour without deviating from the arrangement of a movable tap according to the invention and a flat portion 17 and a ridge portion 16 the contour may be adapted to any magazine suitable to have ammunition cartridges stacked inside the ammunition magazine.

Figure 4:
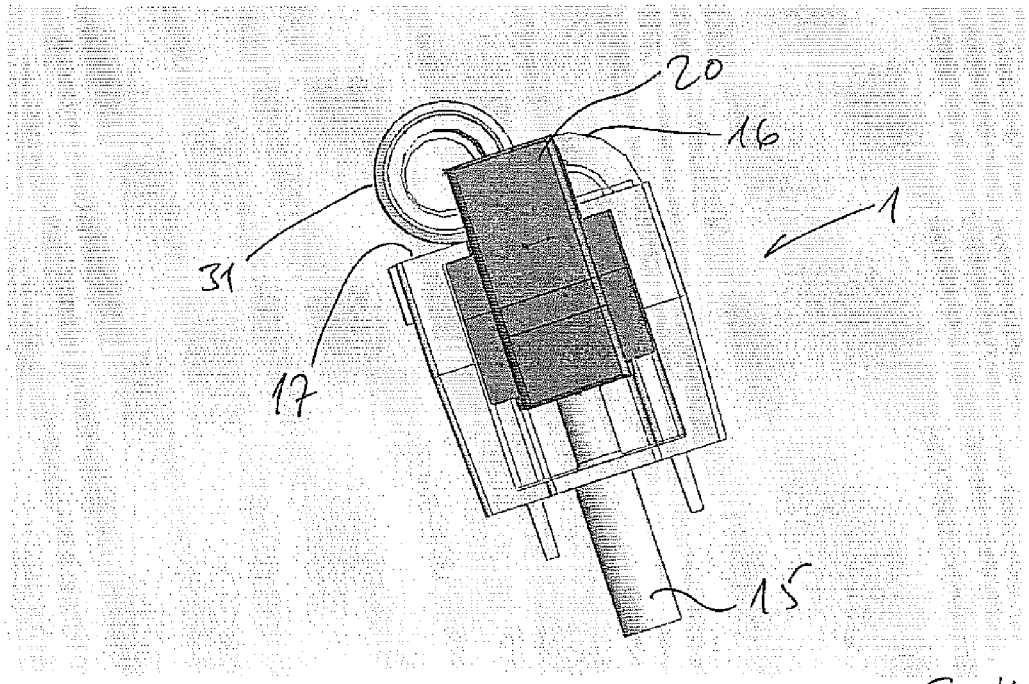
FIG. 4 illustrates the "normal" position where the tap is in a position where the upper part of the tap is substantially flush with the upper edge of the ridge

In FIG. 4 is illustrated the "normal" position where the tap 20 is in a position where the upper part of the tap 20 is substantially flush with the upper edge of the ridge 16. In the embodiments illustrated in the accompanying figures the ridge has the shape of a cartridge, but naturally any shape of the ridge may be utilized as long as it is positioned as illustrated with reference to the accompanying drawings.

Figure 5:
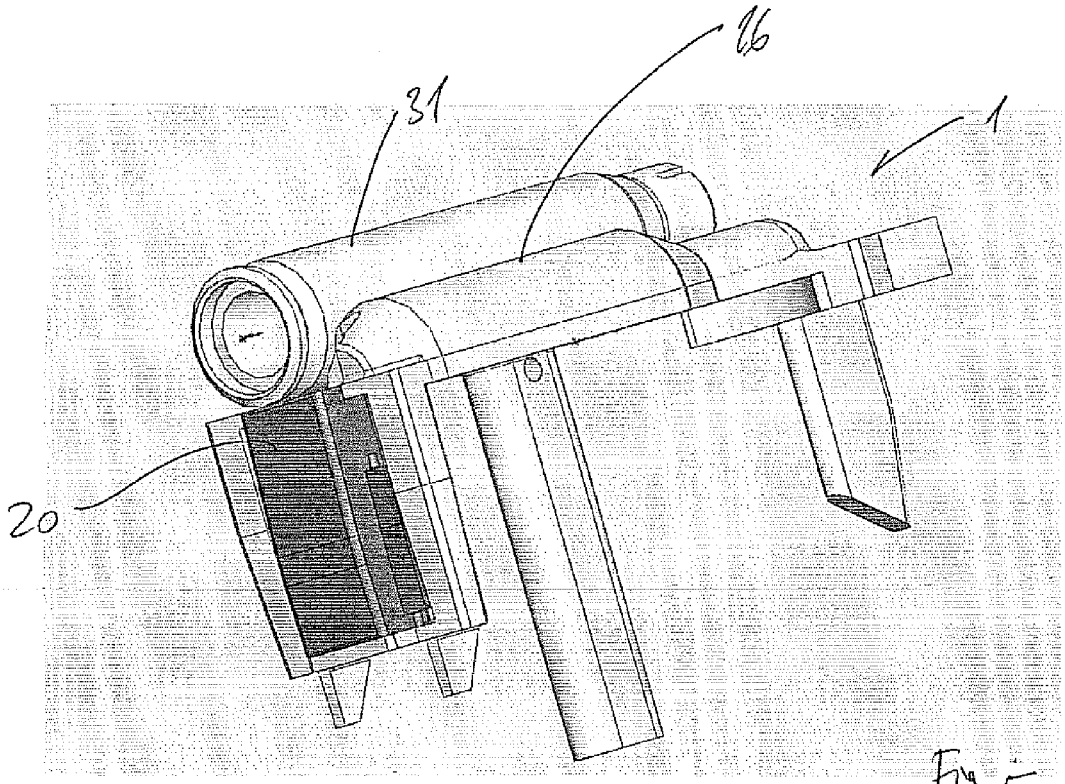
FIG. 5 illustrates the follower with the tap depressed.

A cartridge 31 being the lowermost cartridge in the magazine is illustrated as positioned on the flat bottom portion 17 on the follower 1. As the follower moves upwards due to the spring arranged around the guide member 15, the tap 20 will engage means inside the chamber thereby activating the bolt catch function. As the second to last cartridge is ejected from the chamber in the weapon the follower 1 will move upwards and into a position as illustrated in FIG. 5 where the movable tap 20 has been depressed relative to the ridge 16 and the cartridge 31. In this position the bolt catch function has been activated. The bolt catch mechanism is thereafter manually released, whereby the last cartridge is positioned inside the chamber ready to be fired whereas the magazine and thereby also the follower may be withdrawn and replaced by a fresh, full magazine leaving a live cartridge in the chamber ready to be fired whenever needed. The depression of the tap 20 occurs as the tap engage means inside the chamber which means activate the bolt catch function. Therefore, the means urging the tap 20 upwards should not be as strong as the spring member urging the follower up through the magazine.

The invention has now been explained with reference to a specific embodiment, but it is clear that variations of the invention are possible as long as the inventive movable tap construction is arranged in order to engage the bolt catch function in the weapon when the second to last cartridge is introduced into the chamber.

The invention claimed is:

1. An ammunition magazine follower configured for use in a magazine of a bolt-action type weapon, the magazine follower comprising:

a main bottom member defining an upper and lower surface, where said upper surface comprises a substantially flat portion and a ridge portion, where said flat and ridge portions are arranged in a longitudinal direction of the main bottom member;

guide means on the lower surface for guiding said follower in the magazine;

means for accommodating urging means, which urging means in use, when the follower is installed in a magazine, urges the follower away from the magazine bottom;

wherein the guide means comprises at least one end wall projecting substantially perpendicularly away from said lower surface of said main bottom member, where said end wall comprises a moveable tap, where an upper part of said tap, by biasing means, in use projects at least partly above said upper surface of the main bottom member, and wherein said tap extends to a level where engagement of a bolt of the weapon occurs after a second to last round is fired from the magazine.

2. The ammunition magazine follower according to claim 1, wherein the end wall is provided with a cavity arranged in the end-wall's longitudinal direction, which cavity is open towards the main bottom member, where said tap is moveably arranged in said cavity, and where a cavity bottom is provided in the cavity, where a spring member is arranged between said cavity bottom and the tap, said spring urging the tap away from the cavity bottom.

3. The ammunition magazine follower according to claim 2, wherein stop means are provided in the cavity, which stop means interacts with said tap, limiting the tap's travel in the cavity.

4. The ammunition magazine follower according to claim 1, wherein the part of the tap projecting above the main bottom member projects such that the upper most part of the tap is flush with the upper most part of the ridge portion.

5. The ammunition magazine follower according to claim 1, wherein the tap has a substantially rectangular or quadratic cross section defining four sides, with a hollow central part, and where wings are arranged projecting out from two opposing sides of the tap, and where a section of an, in use uppermost part of a side is lower than the other three sides.

6. The ammunition magazine follower according to claim 1, wherein a last round of the magazine remains in the magazine after the engagement of the bolt by said tap.

* * * * *